United States Patent [19]

Cromas et al.

[11] 4,203,395

[45] May 20, 1980

[54] CLOSED-LOOP IDLE SPEED CONTROL SYSTEM FOR FUEL-INJECTED ENGINES USING PULSE WIDTH MODULATION

[75] Inventors: Joseph C. Cromas, Newport News, Va.; Thomas P. Green, South Bend, Ind.

[73] Assignee: The Bendix Corporation, Troy, Mich.

[21] Appl. No.: 833,779

[22] Filed: Sep. 16, 1977

[51] Int. Cl.[2] ..... F02D 1/04

[52] U.S. Cl. ..... 123/32 EA; 122/102; 123/32 EG; 123/32 EH; 123/32 EL

[58] Field of Search ..... 123/32 EA, 32 EG, 32 EH, 123/32 EL, 102

[56] References Cited

U.S. PATENT DOCUMENTS

| | | | |
|---|---|---|---|
| 3,643,635 | 2/1972 | Milam | 123/32 EA |
| 3,664,311 | 5/1972 | Endo | 123/32 EG |
| 3,750,632 | 8/1973 | Zechnall | 123/32 EA |
| 3,822,679 | 7/1974 | Hobo | 123/32 EA |
| 3,858,561 | 1/1975 | Aono | 123/32 EA |
| 3,863,054 | 1/1975 | Monpetit | 123/32 EA |
| 3,868,933 | 3/1975 | Bigalke | 123/32 EA |
| 3,889,647 | 6/1975 | Rachel | 123/32 EA |
| 3,960,130 | 6/1976 | Peterson | 123/179 A |
| 3,964,457 | 6/1976 | Coscia | 123/32 EA |

*Primary Examiner*—Bernard Konick
*Assistant Examiner*—Alan Faber
*Attorney, Agent, or Firm*—Robert C. Smith; William F. Thornton

[57] ABSTRACT

A closed loop idle speed controller for a fuel injection system operates to control an air valve which controls an air passage bypassing the main air flow. The air valve is positioned by an actuator whose output position is controlled by fuel pressure operating against a spring. The fuel pressure is controlled by a pair of solenoid-operated on-off valves, one of which responds to electrical signals representing engine speeds below a speed reference to direct fuel to the actuator and the other of which responds to signals representing speeds above the reference to permit fuel to be withdrawn from the actuator and returned to its source. Each of the solenoid on-off valves is supplied from a pulse width modulator. The engine-driven distributor provides pulses responsive to engine speed which are connected to a sample and hold circuit. The sample and hold circuit provides d.c. voltage levels proportional to engine rpm, modified with changes in engine coolant temperature, to a pair of summing amplifiers which compare the modified speed voltage with an idle speed reference voltage to produce speed error signals. Underspeed signals are connected to the pulse width modulator connected to the supply solenoid on-off valve and overspeed signals to the modulator connected to the return solenoid on-off valve. Certain auxiliary circuits provide for modified operation during starting, during hot starts, during closed throttle operation, or during deceleration with a manual transmission car.

10 Claims, 7 Drawing Figures

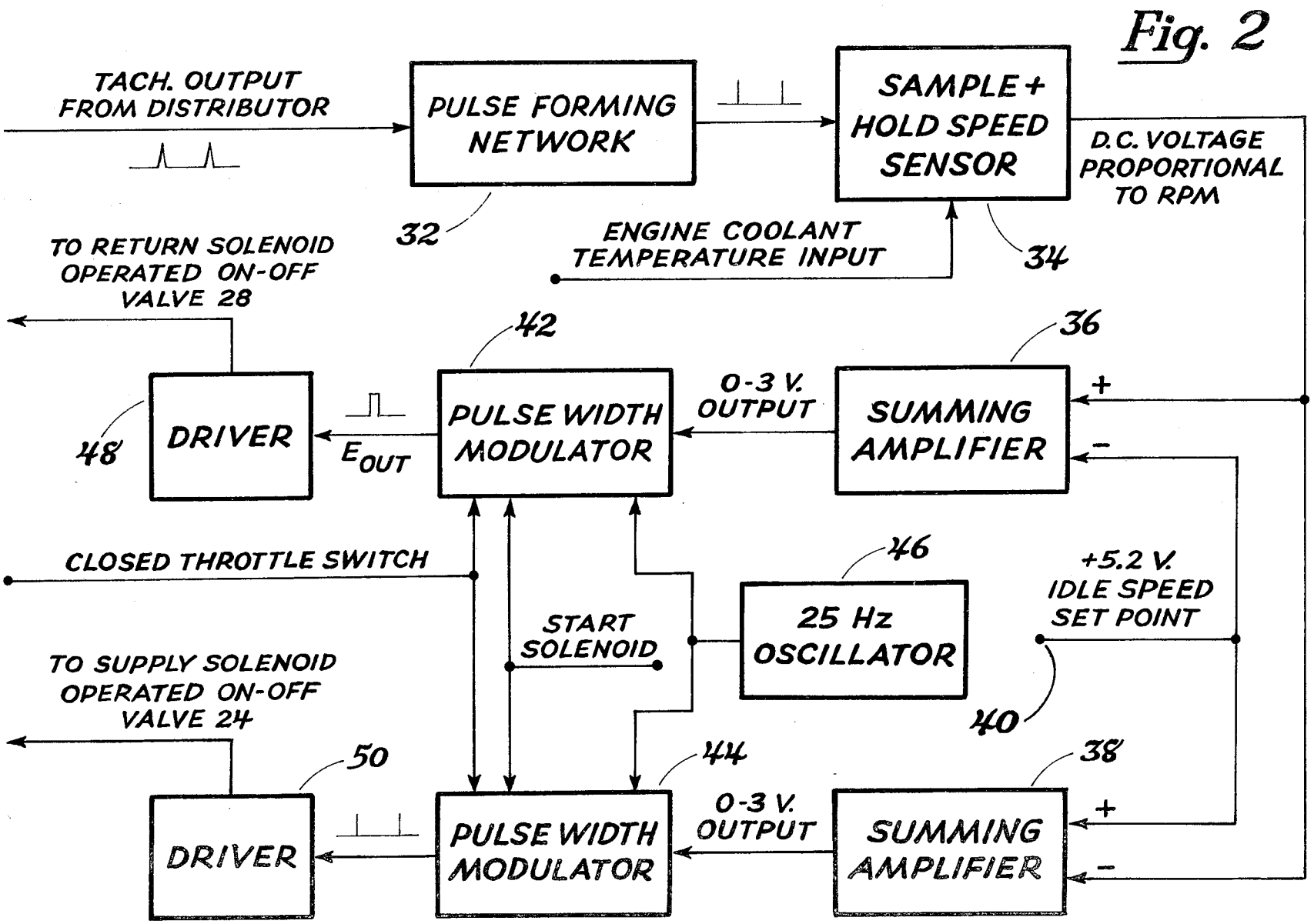
Fig. 2
D.C. VOLTAGE PROPORTIONAL TO RPM
SAMPLE+ HOLD SPEED SENSOR
34
36
SUMMING AMPLIFIER
+
-
+5.2 V. IDLE SPEED SET POINT
40
38
SUMMING AMPLIFIER
+
-
ENGINE COOLANT TEMPERATURE INPUT
46
25 Hz OSCILLATOR
0-3 V. OUTPUT
0-3 V. OUTPUT
44
PULSE FORMING NETWORK
32
42
PULSE WIDTH MODULATOR
START SOLENOID
PULSE WIDTH MODULATOR
$E_{OUT}$
50
TACH. OUTPUT FROM DISTRIBUTOR
TO RETURN SOLENOID OPERATED ON-OFF VALVE 28
DRIVER
48
CLOSED THROTTLE SWITCH
TO SUPPLY SOLENOID OPERATED ON-OFF VALVE 24
DRIVER AA+
AA+
68
72
70
98
104
105
100
74
GATE TRIGGER
ON TRAILING
EDGE
102
96
94
AA+
82
86
92
90
88
84
80
78
AA+
AA+
AA+
AA+
62
64
66
76
60

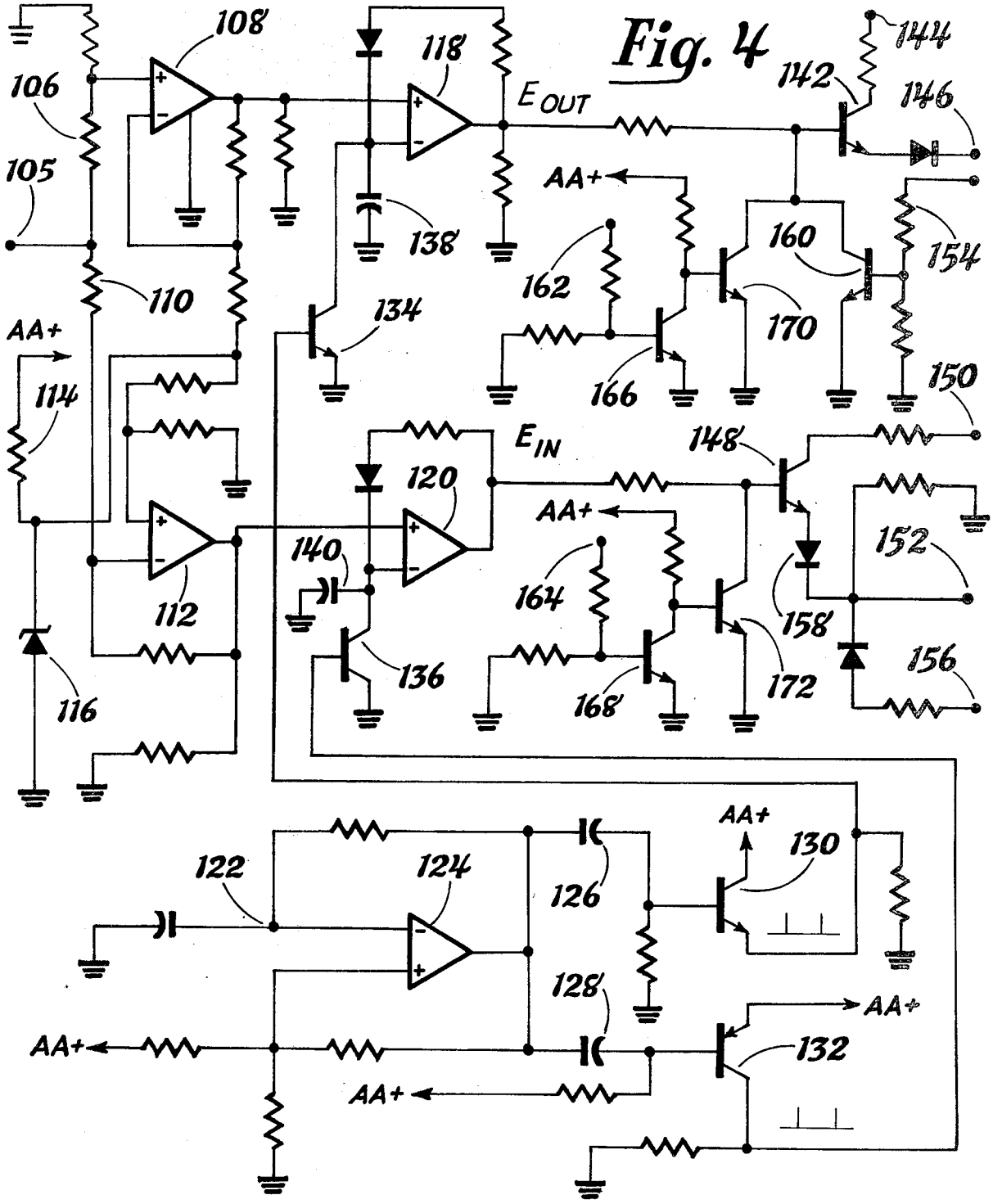
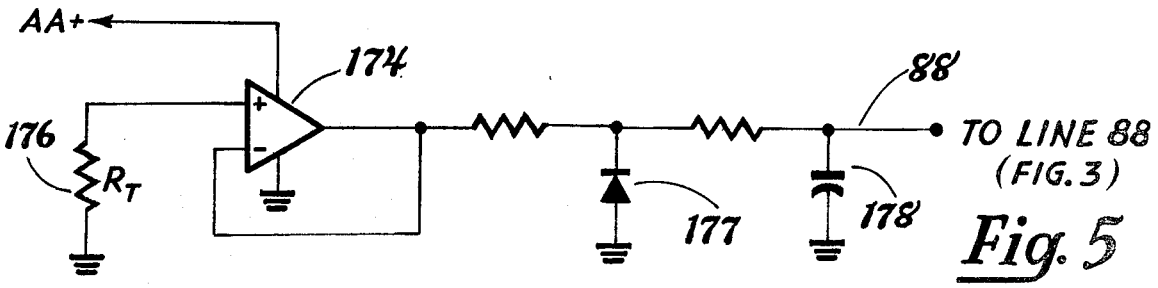
Fig. 5

CLOSED-LOOP IDLE SPEED CONTROL SYSTEM FOR FUEL-INJECTED ENGINES USING PULSE WIDTH MODULATION

BACKGROUND OF THE INVENTION

Electronic fuel injection systems for automotive engines normally provide actuating pulses for operating solenoid-type fuel injectors. These pulses are variable as to width in response to many engine operating conditions including rotational speed, intake manifold vacuum, throttle angle, etc. Engine idle speeds are frequently set by means of a simple set screw adjustment which may include a temperature-responsive means for permitting somewhat faster idle speeds when the engine is cold. Such simple adjustment means are not always capable of compensating for a number of engine operating variables including the reduction in friction within the engine as it is run in. Normally an idle speed adjustment will be made at the factory, at least one other adjustment made at the dealership at the time the car is sold, and still another after the engine has been run for about 150 miles. With this and various other loading factors such as that imposed by air conditioning which may or may not be turned on, with large operating temperature variations and other variables, it becomes apparent that providing some type of closed loop speed control on idle speed is desirable. Such system must be capable of maintaining control system stability over a wide range of engine operating conditions. One standard means of increasing stability is to reduce the gain of the system; however, applicants have found that a very low gain will permit a substantial change in idle speed set point as engine conditions are changed. Thus a stable idle speed reference is highly desirable to avoid such changes in set point. Good stability should be assured despite changes in coolant temperature, air conditioning load, rapid fluctuations between idle flow conditions, and part throttle conditions, etc.

DESCRIPTION OF THE DRAWINGS

FIG. 2 is a control logic block diagram of the system of FIG. 1;

FIG. 4 is an electrical schematic diagram of the remaining part of the system of FIGS. 1 and 2;

FIG. 5 is a schematic diagram of the temperature compensation circuit forming part of the system of FIGS. 3 and 4;

DESCRIPTION OF THE PREFERRED EMBODIMENT

Figure 1:
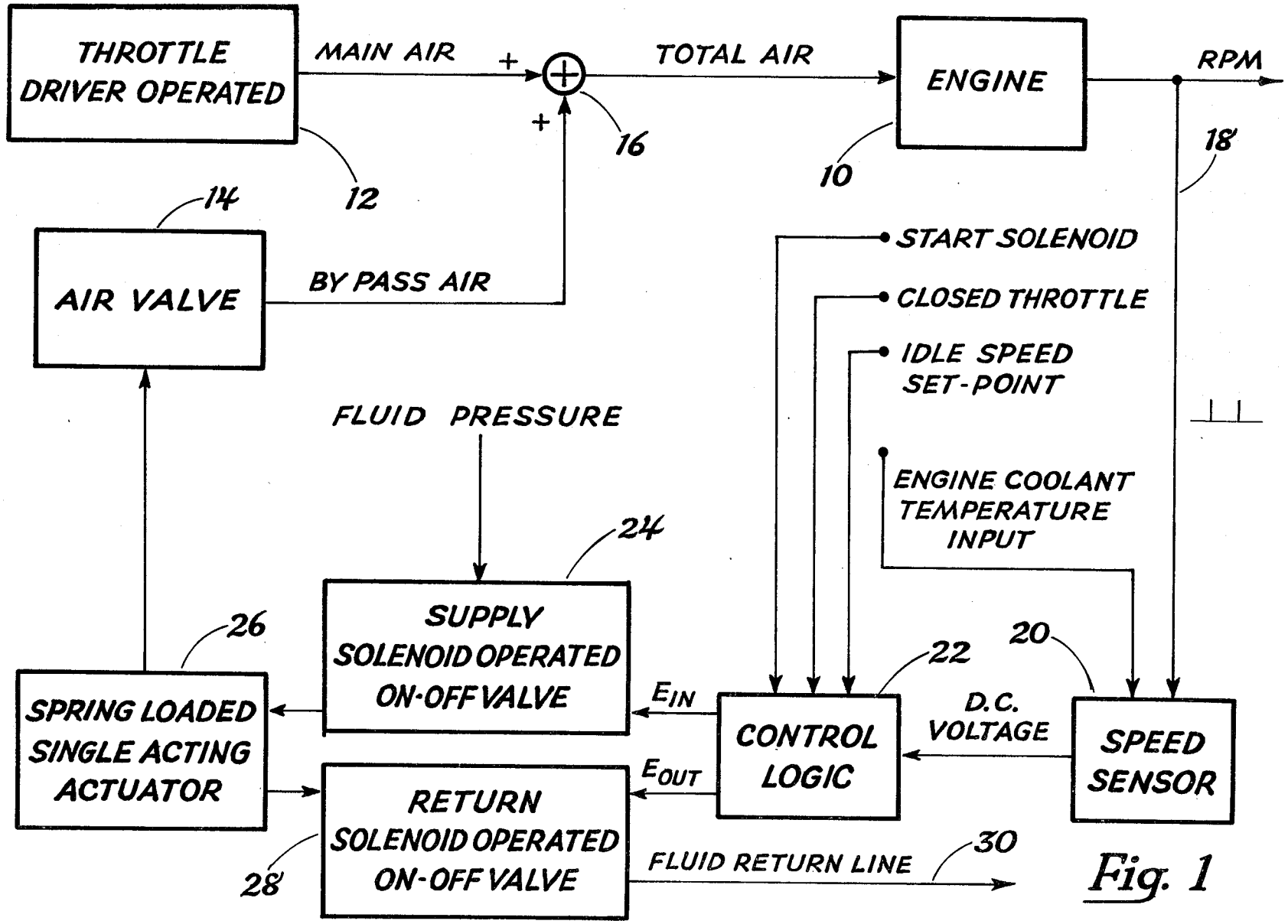
FIG. 1 is a system block diagram of an idle speed control incorporating our invention.

In the system block diagram of FIG. 1 it will be seen that the speed of the engine is controlled through controlling the air flow to the engine primarily through the throttle 12 which is operated by the driver and secondarily through an air valve 14 which controls the amount of air bypassing the main throttle and entering the intake manifold. This function is shown by means of the adder 16. If the throttle 12 is closed, there may still be a significant amount of air supplied through the operation of air valve 14 to maintain engine idle speed. A distributor driven by the engine 10 provides a series of pulses whose frequency is directly proportional to RPM, and these pulses are supplied through a line 18 to a speed sensor 20. Speed sensor 20 operates to convert the ignition pulse train into a direct current voltage of magnitude generally proportional to the frequency of the input pulses appearing on line 18 but modified by an input signal responsive to engine coolant temperature, as indicated. The purpose of this arrangement, of course, is that it effectively increases the engine idle speed set point to a higher speed during engine warm-up. After the engine has reached a smooth operating temperature, this circuit is no longer in use. This direct current voltage representing engine speed is compared in a control logic section 22 with a reference voltage representing the idle speed set point. The speed error signal resulting from this comparison will represent whether the engine speed is above or below the set point and the magnitude of the error. This informationn is used to provide two outputs. One output error signal which represents speed below the set point controls the supply solenoid operated on-off valve 24 which, in turn, controls the supply of fuel to a spring-loaded single-acting actuator 26. It is the function of actuator 26 to control operation of air valve 14 to thereby establish the amount of bypass air supplied to the engine 10. The other output ($E_{out}$) which is in response to speeds above the set point is supplied to a return solenoid-operated on-off valve 28 which controls the amount of fuel in actuator 26 which is permitted to return to the tank through the fuel return line 30. The output labeled $E_{out}$ is zero when the speed is below the set point and a fixed frequency pulse train when the speed is above the set point. The output labeled $E_{in}$ is zero when the speed is above the set point and a pulse train when the speed is low. In each case the pulse widths are controlled by the magnitude of the speed error signal. The solenoid-operated on-off valves will remain open for the duration of the pulse.

It will be noted that the control logic unit 22 also has inputs from a closed throttle switch which has the function of holding the solenoid on-off valves in position when the throttle is open, as will be discussed below. Also supplied to control logic unit 22 is an input signal from the start solenoid which allows the air valve to open faster than normal at the time of engine start-up by energizing the supply solenoid 24. Without the above option, the normal logic system would not supply needed air flow quick enough during cold engine starting to prevent the engine from flooding before start-up.

FIG. 2 is a control logic block diagram of the system heretofore described. In this system, the distributor output consisting of a series of voltage spikes of frequency varying with engine speed is supplied to a pulse-forming network 32 which converts these voltage spikes into a series of uniform trigger pulses which are supplied to the sample and hold speed sensor 34. Again, this speed sensor has an input from the engine coolant temperature for the purpose of varying the output, which is a direct current voltage proportional to RPM, with coolant temperature. This output is supplied to each of two summing amplifiers 36 and 38, amplifier 36 controlling return flow and the other summing amplifier 38 controlling supply flow. Each of these amplifiers receives an idle speed set point signal from a regulated voltage source 40. The summing amplifier 36 will produce an output varying in voltage, depending upon the magnitude of the speed error above the idle speed set point to a pulse width modulator 42.

When the engine speed is below that set on the idle speed set point, the summing amplifier 38 will have a d.c. output varying in magnitude with the speed error, and this output is supplied to a pulse width modulator 44. At a given engine speed only one of summing amplifiers 36 or 38 can have an output voltage, but if the engine speed corresponds with the desired engine speed as requested from idle speed set point 40, neither summing amplifier will have an output voltage. A 25 Hz oscillator 46 is connected to each of pulse width modulators 42 and 44. It serves to convert a speed error signal from either of summing amplifiers 36 or 38 into a string of pulses having a width proportional to the magnitude of the speed error. The opposite pulse width modulator will also produce a series of narrow pulses which are supplied to one of the two driver circuits 38 or 50. In the example shown in FIG. 2, pulse width modulator 42 is producing output pulses of significant width to driver 48, and pulse width modulator 44 is producing very narrow pulses to driver 50. These pulses to driver 50 are too short to cause operation of the supply solenoid-operated on-off valve 24. The pulses of substantial width supplied to driver 48 will cause this driver to operate the return solenoid-operated on-off valve 28 to return fuel to the tank, thereby reducing air flow.

The start solenoid input signal and the closed throttle switch input signal are connected to both of pulse width modulators 42 and 44. As shown, the start solenoid signal causes the modulator 44 to provide a high level signal during start-up to the driver 50 which holds the supply solenoid-operated on-off valve open, thus allowing faster opening of the air valve than normally supplied through the idle speed logic. Similarly, the closed throttle switch will shut off valves 24 and 28 so that air valve 14 will not react and move when the driver opens throttle 12.

Figure 3:
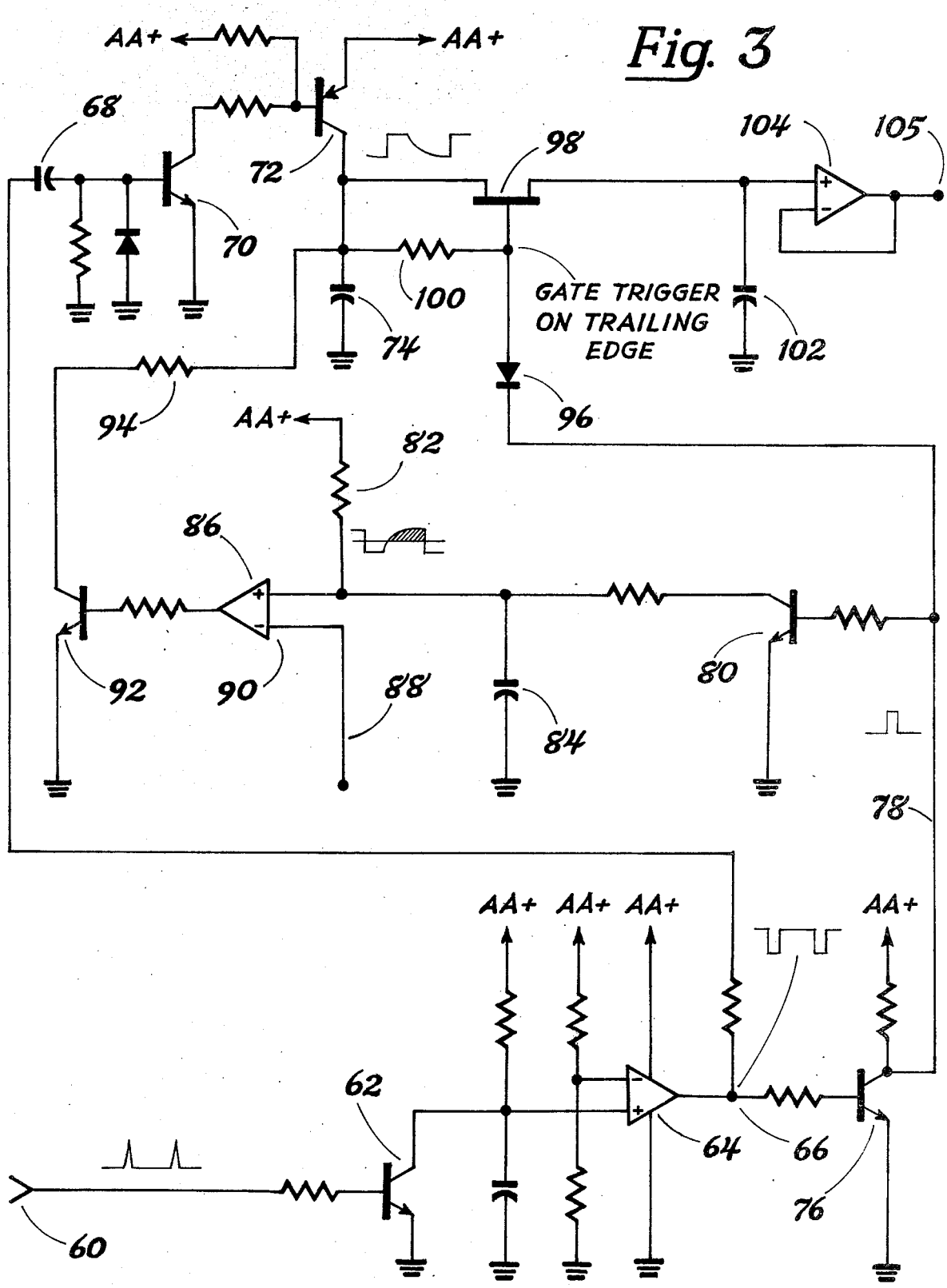
FIG. 3 is an electrical schematic diagram of part of the system of FIGS. 1 and 2.

Referring now to FIG. 3, the engine distributor output appears at a terminal 60 in the form of a series of ignition spikes. These spikes are supplied to a transistor 62 acting as a switch, and it, in turn, provides an input signal to an operational amplifier 64 whose function is to convert this series of spikes to a string of regular negative-going pulses which appear at a junction 66 as indicated on the diagram. The negative-going pulses appearing at junction 66 are supplied to, among other things, a trigger circuit including a capacitor 68 which will convert these pulses to a series of positive and negative-going spikes, the positive spikes serving to trigger a transistor 70 causing it, in turn, to turn on a transistor 72, thereby connecting the positive voltage source in its emitter circuit directly across a capacitor 74. To simplify the diagram, connections to a suitable d.c. power supply source are shown throughout as connected to AA+.

Referring again to junction 66, the negative-going pulses appearing at this point are also supplied to a transistor 76 which effectively inverts these pulses as indicated by the diagram appearing adjacent lead 78, and these pulses are supplied to the input of a transistor 80. The collector circuit of transistor 80 is connected to a timing circuit consisting of a resistor 82 connected to a source of positive direct current and a capacitor 84 connected to ground. The positive going pulses on line 78 serve to trigger transistor 80 which discharges capacitor 84 connected to operational amplifier 86. Because of the characteristics of timing circuit including resistor 82 and capacitor 84, the voltage appearing at the upper input to operational amplifier 86 builds up at a relatively slow rate. The lower input to operational amplifier 86 comes in on a line 88 to a terminal 90 from the temperature-compensation circuit shown on FIG. 5. The operation of the circuit of FIG. 5 will be described in greater detail below; however, it will be understood that the input voltage supplied to terminal 90 varies with the temperature of the coolant in the associated engine. Operational amplifier 86 acts as a comparator with the two input signals being compared. When the delayed pulse from the timing circuit 82, 84 exceeds the voltage from the temperature compensation circuit appearing on terminal 90, amplifier 86 will produce an output to a transistor 92, turning it on. When transistor 92 is turned on, the voltage on the capacitor 74 is permitted to decay to ground through a resistor 94 at a rate established by this resistor. Thus, the charging pulse across the capacitor 74 is effectively initiated in synchronism with each ignition pulse. This charge remains at maximum value for a time controlled by timing circuit 82, 84, which in conjunction with the coolant temperature signal coming on line 88 controls the time of switching on of transistor 92 which begins the voltage decay pattern from capacitor 74 through resistor 94 to ground. The effect of the operation of the coolant temperature-responsive circuit is to delay the discharge of capacitor 84 to a greater degree, the higher the sensed coolant temperature. Thus the effective wave form across capacitor 74 constitutes the speed error signal as compensated for changes in coolant temperature.

The inverted pulse output from transistor 76, in addition to the functions described above, is supplied through a diode 96 to the emitter junction of a unijunction transistor 98. The diode 96 operates to gate the unijunction 98 on the trailing edge of the pulse from transistor 76, causing the unijunction to transfer the instantaneous voltage on capacitor 74 to a capacitor 102 and to the upper input terminal 105 of an operational amplifier 104. This signal is sensed and held as a series of d.c. voltage levels representing the instantaneous voltage on capacitor 74 as it varies with each ignition pulse. This amplified, stepped d.c. voltage from amplifier 104 is connected through a series resistor 106 forming part of a voltage divider to the upper input (+) of an operational amplifier 108, and also through a series resistor 110 to the lower (−) input to an operational amplifier 112. Connected to the opposite terminals of each of operational amplifiers 108 and 112 is a voltage from a direct current source connected through a resistor 114 and regulated to a steady value, such as 5.2 volts, by means of a zener diode 116. This zener set point voltage value is chosen such that it is somewhere on the voltage decay characteristic of capacitor 74. This regulated voltage is combined with the signal on capacitor 74 in both operational amplifiers 108 and 112. Amplifier 108 is part of the return solenoid circuit, and the set point voltage is subtracted from the d.c. output of amplifier 104. When amplifier 104 output is below or at the level of the set point voltage, there is no output from amplifier 108. Similarly, the operational amplifier 112 is part of the supply solenoid circuit, and the amplifier 104 d.c. signal is subtracted from the set point voltage. In this case there will be an output from amplifier 112 when the set point voltage is higher than the d.c. rpm signal from amplifier 104.

The output signals from amplifiers 108 and 112 are supplied to additional operational amplifiers 118 and 120, respectively. Also connected to amplifiers 118 and 120 are input signals originating from a 25 Hz square wave oscillator 122 including an operational amplifier 124 which produces a series of square pulses and which are corrected through capacitors 126 and 128 to each of two transistors 130 and 132, respectively. Transistors 130 and 132 are connected such that they provide short spike output pulses (0.5 msec.) on opposite half cycles of oscillator 122. The chain of spikes from transistor 130 is connected to a transistor 134, and those from transistor 132 are connected to a transistor 136. Each of operational amplifiers 118 or 120 will have a high output whenever the output of one of the summing amplifiers 108 or 112 is higher than the voltage on the corresponding charging capacitor 138 or 140. The time between the output pulses is controlled by the 25 Hz oscillator 122. The charging capacitors 138 and 140 are discharged by the pulse from oscillator 122, the leading edges of the oscillator square wave pulse effectively being used to discharge capacitor 138 as transistor 134 is turned on by the leading edge pulse from transistor 130. Similarly, capacitor 140 is discharged as transistor 136 is turned on by the trailing edge pulse from transistor 132.

When either of operational amplifiers 108 or 112 has an output of substantial voltage, this results in output pulses of substantial width from the corresponding amplifier 118 or 120 at the 25 Hz rate to drive one of the solenoid valves 24 or 28. At this time, the opposite of amplifiers 118 or 120 will produce only a narrow pulse of insufficient length to operate the opposite solenoid valve. When the engine is at the correct idle speed, no output pulses will occur, but when the engine speed is incorrect either the return or supply solenoid-operated valves will receive pulses with the pulse widths increasing as the speed error becomes greater. Pulses on the return channel are supplied from amplifier 118 to a transistor 142 connected to a source of battery voltage at terminal 144 and then to an output terminal 146. Supply pulses from amplifier 120 are connected to a transistor 148 supplied from a source of battery voltage at terminal 150 where they are amplified and fed to output terminal 152.

Also included in the control system is a circuit which operates while cranking to force the supply solenoid-operated valve to let maximum air into the engine. The terminals 154 and 156 in the return and supply circuits, respectively, are supplied with full battery voltage while cranking the engine and during normal operations are at ground potential. When battery voltage is supplied to terminal 156, it acts through a diode 158 to provide a voltage at output terminal 152 holding the supply solenoid full on. At the same time, this voltage supplied to terminal 154 serves to switch on a transistor 160, thereby grounding any output from amplifier 118.

A closed throttle circuit is provided in the output circuits of amplifiers 118 and 120 which operates to hold the solenoid on-off valves in position whenever the driver takes the engine off of idle operation. Where the idle control to remain fully operational, it would respond to normal operating speeds by shutting the idle air flow to a minimum. Then when the driver quickly releases the accelerator, allowing the engine to snap back to idle condition, it would tend to stall. This function was found to be particularly necessary where the engine is subject to variable loading such as by an air conditoner. During idle or closed throttle operation, a closed throttle switch (not shown) operates to put a direct current voltage (9.5 V. via a 300-ohm source impedance) on each of a pair of terminals 162 and 164. During normal part or full throttle operation, these terminals are open-circuited. When a voltage is applied at terminals 162 and 164, a pair of transistors 166 and 168 are caused to conduct which, in turn, switches off a pair of transistors 170 and 172 to which they are connected, thus permitting the idle speed control to supply pulses to the on-off solenoids 24 and 28. If the driver then commands a higher engine speed, the closed throttle voltage is removed from terminals 162 and 164, transistors are shut off, and any output from the idle speed circuits is grounded through transistors 170 and 172. This leaves the solenoid on-off valves 24, 28 in the position which they last occupied while the idle system was in operation, thereby maintaining the air valve 14 in a somewhat open position.

Figure 6:
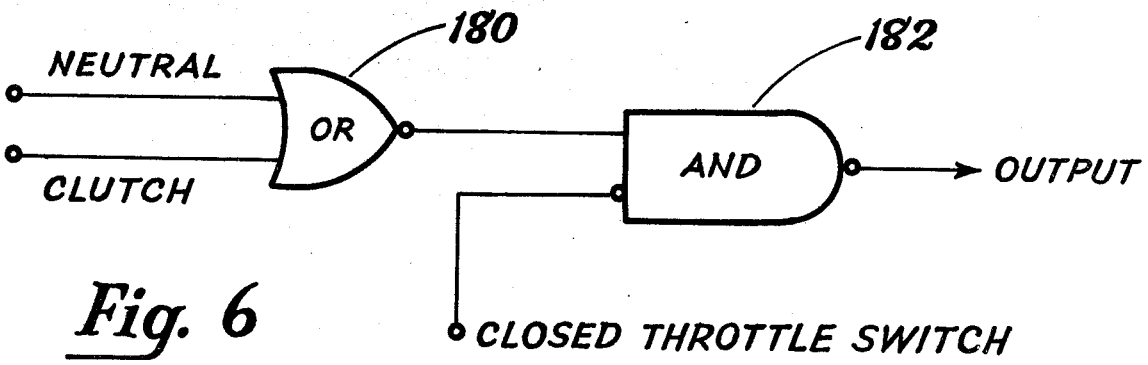
FIG. 6 is a logic diagram for a modification of the system described in FIGS. 1 through 5.

In FIG. 5 is shown a coolant temperature circuit including an operational amplifier 174 which receives an input voltage from a source including a temperature-responsive resistor 176 exposed to engine coolant temperature and whose resistance varies substantially over a range from −40° F. to 190° F. This results in a comparable percentage voltage increase at the output of amplifier 114 with increasing temperature. This voltage output appears across a zener diode 177 which has a breakdown voltage corresponding to that produced at the output of amplifier 174 when the engine reaches a normal operating temperature such as 160° F. A by-pass capacitor 178 serves to ground any unwanted voltage spikes which might tend to produce erroneous reference values. Thus the zener diode 177 limits the voltage appearing on line 88 such that no further temperature compensation occurs with temperatures above the selected normal temperature value. The circuit of FIG. 5 would thereby result in engine idle speed settings substantially higher than normal at −10° F., somewhat higher at 70° F., but remaining at the desired minimum value at temperatures above 160° F. Typical resulting idle speed values would be 1000 rpm at −10° F., 775 rpm at 70° F., and 625 rpm at 160° F. with further increases in operating temperature above 160° F. being ineffective to produce any significant change in the idle speed setting.

Where an automatic transmission is used, the engine tends to return to idle speed or near idle speed when the throttle is closed—at least when operating in its top gear. With a manual transmission the operator will frequently close the throttle while the engine is at relatively high speed, at which time the forward momentum of the car drives the engine against the effect of engine braking and the engine continues to turn at high rpm, even though decelerating. If the idle speed control is connected under these conditions, it would sense a high rpm and close the idle air valve 14. Then when the engine does reach idle speed it would tend to stall. A simple logic circuit like that shown in FIG. 6 will avoid this problem. Either a signal responsive to a neutral position of the transmission or a signal responsive to a depressed clutch pedal is supplied to an "OR" gate 180. If either of these signals is present, gate 180 provides an output to an "AND" gate 182. Also connected to an input of "AND" gate 182 is a signal from the closed throttle switch. This latter signal must be present as well as the input from "OR" gate 180 for "AND" gate 182 to provide an output. This output signal is then used to enable an output from the closed loop idle speed control. Specifically the output may be connected to terminals 162 and 164. Absent such an output, the idle speed control is kept disconnected from the solenoid-operated on-off valves 24 and 28, and they are held at their last position in much the same manner as described above with respect to the closed throttle circuit.

Figure 7:
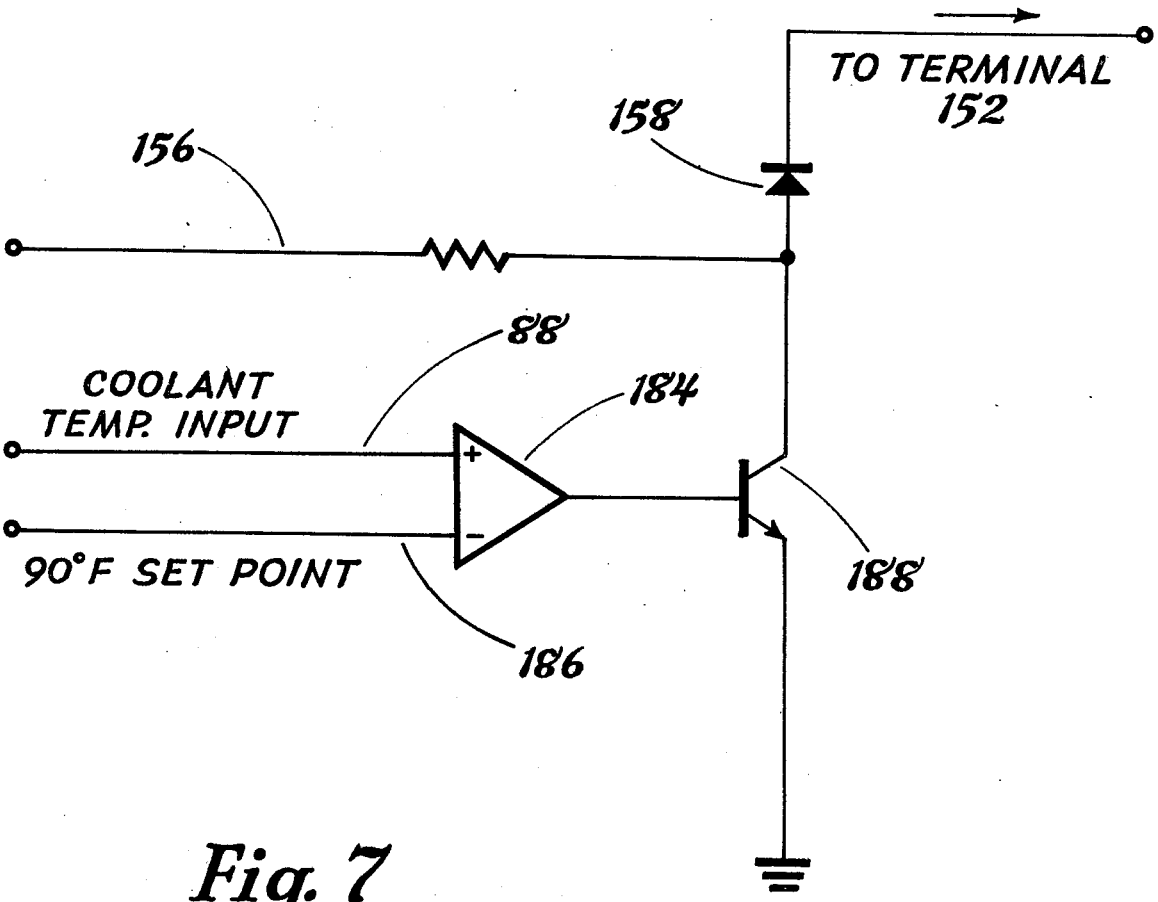
FIG. 7 is a schematic diagram of a hot re-start circuit which may be included in the system of FIGS. 1 through 5.

An additional feature which may be added as required is a hot re-start circuit such as that shown in FIG. 7. This circuit prevents the start solenoid circuitry from opening the air valve during hot engine starting above a coolant temperature of 90° F., for example. The coolant temperature input such as that appearing on line 88 is supplied to an operational amplifier 184 where it is compared with the temperature reference signal on a line 186. Temperatures above the reference signal will provide an output from operational amplifier 184 which turns on a transistor 188, which results in connecting the signal to supply solenoid 24 to ground. Thus the air valve 14 is prevented from opening at warm coolant temperatures on re-start. Without this circuitry, warm engine starts would result in a high rpm overshoot before returning to the correct idle speed.

From the foregoing, it will be recognized that the idle speed control system described above is effective not only to control the idle speed to desired values but to provide a precisely controlled fast idle for low operating temperatures, for avoiding stalling on sudden decelerations, especially under a variable load such as air conditioning, and for assuring the required air supply during cranking. It provides an adaptive gain feature which gives faster response to large speed errors and a low response rate when operating near the idle speed set point for stable operation. Those skilled in the art will recognize that the actual implementation of this system could take a number of forms, and it is to be understood that our invention is not to be limited to the actual embodiment shown and described herein.

We claim:

1. In an electronic fuel injection system for an engine having an engine-driven distributor and wherein said injection system includes an air passage and a throttle plate controlling the main supply of air through said passage to said engine, and means including fuel pump for providing a source of fuel under a regulated pressure;

an idle speed control including an air valve for controlling a source of auxiliary air to said engine, a spring-loaded actuator for said air valve in which said spring is opposed by a fluid pressure derived from said source of regulated fuel pressure, a supply solenoid-operated on-off valve for controlling the fuel pressure from said source to said actuator, a return solenoid-operated on-off valve for controlling the flow of fuel from said actuator to a return line, means associated with said distributor for producing a series of pulses varying with the speed of said engine, means producing a voltage varying with engine coolant temperature, a sample and hold circuit receiving said pulses and said temperature-varying voltage and producing a direct current voltage varying with engine rotational speed modified with changes in coolant temperature, a source of regulated direct current voltage and means comparing said regulated direct current voltage with the output of said sample and hold circuit, a return flow summing amplifier connected to receive the output of said comparing means when said sample and hold circuit output is greater than said regulated direct current voltage, a supply summing amplifier connected to receive the output of said comparing means when said sample and hold circuit output is less than said regulated direct current voltage, a pulse width modulator connected to each of said summing amplifiers including an oscillator, said modulators operating to convert the output of said amplifiers to a series of pulses at said oscillator frequency with the width of said pulses being proportional to the magnitude of the outputs of said summing amplifiers, and driver means responsive to said pulse width modulator output signals for driving said return and supply solenoid-operated on-off valves.

2. An idle speed control for an electronic fuel injection system as set forth in claim 1 wherein means are provided, responsive to cranking of said engine during starting, for shorting any input to said return solenoid-operated on-off valve and for placing a substantial input signal on said supply solenoid-operated on-off valve to assure that said auxiliary air valve will quickly open.

3. An idle speed control for an electronic fuel injection system as set forth in claim 1 wherein means are provided including transistor switching means connected in the output circuits of each of said pulse width modulators, with means responsive to open throttle conditions operative to switch said outputs to ground, thus holding said actuator in its last position before open throttle operation, and responsive to closed throttle conditions to open said switch means to return said idle speed control to normal operation.

4. An idle speed control for an electronic fuel injection system as set forth in claim 2 wherein means are provided including transistor switching means connected in the output circuits of each of said pulse width modulators, with means responsive to open throttle conditions operative to switch said outputs to ground, thus holding said actuator in its last position before open throttle operation, and responsive to closed throttle conditions to open said switch means to return said idle speed control to normal operation.

5. An idle speed control for an electronic fuel injection system as set forth in claim 1 in which said sample and hold circuit includes a capacitor having a known voltage decay characteristic and a timing circuit responsive to said pulses responsive to engine speed for controlling the time at which the voltage on said capacitor begins to decay.

6. An idle speed control for an electronic fuel injection system as set forth in claim 5 wherein said engine coolant temperature response means includes a temperature-variable resistor, circuit means operative in combination with said temperature-variable resistor to provide a voltage varying with coolant temperature, and means connecting said temperature-varying voltage to said timing circuit to vary the time at which the voltage on said capacitor begins to decay to thereby vary the controlled idle speed.

7. An idle speed control for an electronic fuel injection system as set forth in claim 6 wherein a zener diode is connected across said coolant temperature-varying voltage to limit said voltage such that increases in coolant temperature above a desired normal operating temperature produce no further changes in engine idle speed.

8. In an electronic fuel injection system for an engine having an engine-driven distributor and wherein said injection system includes a main air passage and a throttle controlling the main air supply to said engine through said air passage and a fuel pump for providing a source of fuel, an idle speed control including an air valve for controlling a source of air to said engine bypassing said main air passage, a spring-loaded actuator for said air valve in which said spring is opposed by a fluid pressure derived from said source, electrohydrualic means for controlling fuel pressure from said source to said actuator and from said actuator to a line returning fuel to its source, said electrohydraulic means includes a return solenoid-operated on-off valve connected to control the flow of fuel from said actuator to the return side of said source and a supply solenoid-operated on-off valve connected to control the flow of fuel from said source to said actuator, means responsive to said distributor for producing a series of pulses varying with the speed of said engine, means producing a voltage varying with engine coolant temperature, circuit means receiving said pulses and said temperature-varying voltage producing a direct current voltage varying with engine rotational speed modified with changes in coolant temperature, a source of regulated direct current voltage and means comparing said regulated direct current voltage with the output of said circuit means, said comparing means including separate summing amplifiers connected to each of said return and supply solenoid-operated on-off valves, and pulse width modulation means connected to each of said summing amplifiers, said modulation means including an oscillator, said comparing means being operative to convert the output of said summing amplifiers to a series of pulses at said oscillator frequency with the width of said pulses being proportional to the magnitude of the outputs of said summing amplifiers.

9. An idle speed control for an electronic fuel injection system as set forth in claim 8 wherein said circuit means includes a sample and hold circuit including capacitance means having a known voltage decay characteristic and a timing circuit responsive to said speed-varying pulses for controlling the time at which the voltage on said capacitance means begins to decay.

10. An idle speed control for an electronic fuel injection system as set forth in claim 9 wherein said means producing a voltage varying with engine coolant temperature includes temperature-variable resistance means, circuit means operative in combination with said temperature-variable resistance means to provide said engine temperature-responsive voltage, and means connecting said engine temperature-responsive voltage to said timing circuit to vary the time at which the voltage on said capacitance means begins to decay.

* * * * *